United States Patent [19]

Garron et al.

[11] 4,188,900

[45] Feb. 19, 1980

[54] METHOD OF BUTTONHOLE FORMATION

[75] Inventors: Stephen A. Garron, Elizabeth; Charles R. Odermann, Montville, both of N.J.

[73] Assignee: The Singer Company, New York, N.Y.

[21] Appl. No.: 36,209

[22] Filed: May 4, 1979

[51] Int. Cl.[2] ..... D05B 3/06

[52] U.S. Cl. ..... 112/264.1; 112/158 B

[58] Field of Search ..... 112/264.1, 431, 437, 112/158 B, 65

[56] References Cited

U.S. PATENT DOCUMENTS

| | | | |
|---|---|---|---|
| 1,483,184 | 2/1924 | McCann | 112/264.1 X |
| 2,977,913 | 4/1961 | Schenkengel | 112/264.1 |
| 3,570,433 | 3/1971 | Weisz | 112/264.1 |
| 4,159,688 | 7/1979 | Garron et al. | 112/158 B X |

*Primary Examiner*—Peter P. Nerbun

*Attorney, Agent, or Firm*—Edward P. Schmidt; Robert E. Smith; Edward L. Bell

[57] ABSTRACT

A method of forming a buttonhole including two spaced apart rows of zig zag stitches so that each row is formed in a like manner with the final overlaying stitches accomplished in the forward direction and which may be initiated by a barring stitch adjacent the edge of the garment followed by a straight stitch down the cutting space to the opposite end of the garment.

3 Claims, 5 Drawing Figures

| ENCODED DATA FOR LARGE BUTTONHOLE | | | |
|---|---|---|---|
| STITCH NO. | CODE | FEED INCREMENT(IN.) | BIGHT POSITION(IN.) |
| 1 | 100100111100 | 0.0 | 0.0 |
| 2 | 100100001100 | 0.0 | +0.120 |
| 3 | 001111101100 | +0.017 | -0.120 |
| 4 | 100100001100 | 0.0 | +0.120 |
| 5 | 111011101100 | -0.017 | -0.120 |
| 6 | 100100001100 | 0.0 | +0.120 |
| 7 | 001111101100 | +0.017 | -0.120 |
| 8 | 100100001100 | 0.0 | +0.120 |
| 9 | 100101101100 | 0.0 | -0.120 |
| 10 | 001110111100 | +0.017 | 0.0 |
| 11 | 001110111101 | +0.017 | 0.0 |
| 12 | 001110111111 | +0.017 | 0.0 |
| 13 | 100100111100 | 0.0 | 0.0 |
| 14 | 111011101100 | -0.017 | -0.120 |
| 15 | 100100001100 | 0.0 | +0.120 |
| 16 | 001111101100 | +0.017 | -0.120 |
| 17 | 100100001100 | 0.0 | +0.120 |
| 18 | 111011101100 | -0.017 | -0.120 |
| 19 | 100100001100 | 0.0 | +0.120 |
| 20 | 100101101100 | 0.0 | -0.120 |
| 21 | 111010001100 | -0.017 | +0.120 |
| 22 | 111010101000 | -0.017 | +0.050 |
| 23 | 111010011000 | -0.017 | +0.090 |
| 24 | 111010101010 | -0.017 | +0.050 |
| 25 | 001110110100 | +0.017 | +0.020 |
| 26 | 001110001110 | +0.017 | +0.120 |
| 27 | 111011100000 | -0.017 | -0.090 |
| 28 | 111011010010 | -0.017 | -0.050 |
| 29 | 001111000100 | +0.017 | -0.020 |
| 30 | 001111101100 | +0.017 | -0.120 |
| 31 | 100101011100 | 0.0 | -0.080 |
| 32 | 100101101100 | 0.0 | -0.120 |

Fig. 4

METHOD OF BUTTONHOLE FORMATION

DESCRIPTION

BACKGROUND OF THE INVENTION

This invention relates to a method of sewing a buttonhole, more particularly, to an improved method in which the final stitching is made in the forward direction and in which buttonholes which are perpendicular to the edge of a garment may be initiated on the end of the buttonhole nearest the edge of the garment.

The buttonhole produced on presently known electronically controlled sewing machines utilizes a travelling buttonhole foot in which a button determines the location of stops which actuate, through a paddle arrangement, switches in the sewing machine to initiate the next series of stitches for the buttonhole. In these prior art sewing machines the buttonhole sequence includes (1) making a first bar (2) implementing narrow bight cording stitches on the left side in the forward feed direction, (3) completing the second bar, (4) finishing the left side with wide bight covering stitches in the reverse direction, (5) implementing the narrow bight cording stitches on the right side in the forward direction, and (6) making wide bight covering stitches in the reverse feed direction over the right side cording stitches. This system was developed and is successful in eliminating the need for adjusting balance, i.e., having the stitches on one side of the buttonhole have the same appearance as the stitches on the other side thereof. However, since the final stitches are accomplished in the reverse direction, they do not have the same appearance as stitching in the forward direction. Since most of the stitching of sewing machines is accomplished in the forward direction, considerable care and attention is devoted to insure that the forward stitch presents a good appearance. For example, in some machines there is a greater tendency to "halo" in the reverse direction, that is to have an extra amount of top thread between stitches, which condition is not evident in the forward direction.

Simply reversing the sequence for making the buttonhole so that the cording stitches are accomplished in the reverse direction and the final covering stitches in the forward direction is not a solution in as much as a problem could occur in the making of a buttonhole which is perpendicular to the edge of a garment. In such a buttonhole, it is desirable that the initial bar tack begin adjacent the edge of the garment since any variation which may take place in the length of a buttonhole will not be as noticeable on the side away from the edge of the garment as it would be next to the edge. Thus, to position the work material adjacent an operator as is usual, and to reverse the above sequence would initiate the buttonhole on its inner side and not adjacent the edge.

What is required is a method for making a buttonhole having the seemingly adverse requirements for accomplishing the final stitches in the forward direction and at the same time having the initial bar tack in a forward direction with respect to the final bar tack.

SUMMARY OF THE INVENTION

The above desired requirement is achieved in a buttonhole method in which the initial bar tack of a buttonhole disposed perendicular to the edge of a garment may be initiated adjacent to the garment edge, and followed immediately by a first row of straight stitches in the forward feed direction down the middle of the buttonhole. Alternatively, the needle bar latching mechanism may be activated during this first row of sraight stitches so as to make them long basting stitches which may be easily removed. Thereafter, the second bar tack may be completed and the cording stitches may be effected in the reverse direction thereby to complete the covering stitches in the forward direction.

BRIEF DESCRIPTION OF THE DRAWING

The foregoing will be more readily apparent upon reading the following description in conjunction with the drawings in which:

FIG. 4 is a table of encoded data for producing a buttonhole pattern in accordance with the method of this invention.

DESCRIPTION OF THE PREFERRED EMBODIMENT

Figure 1:
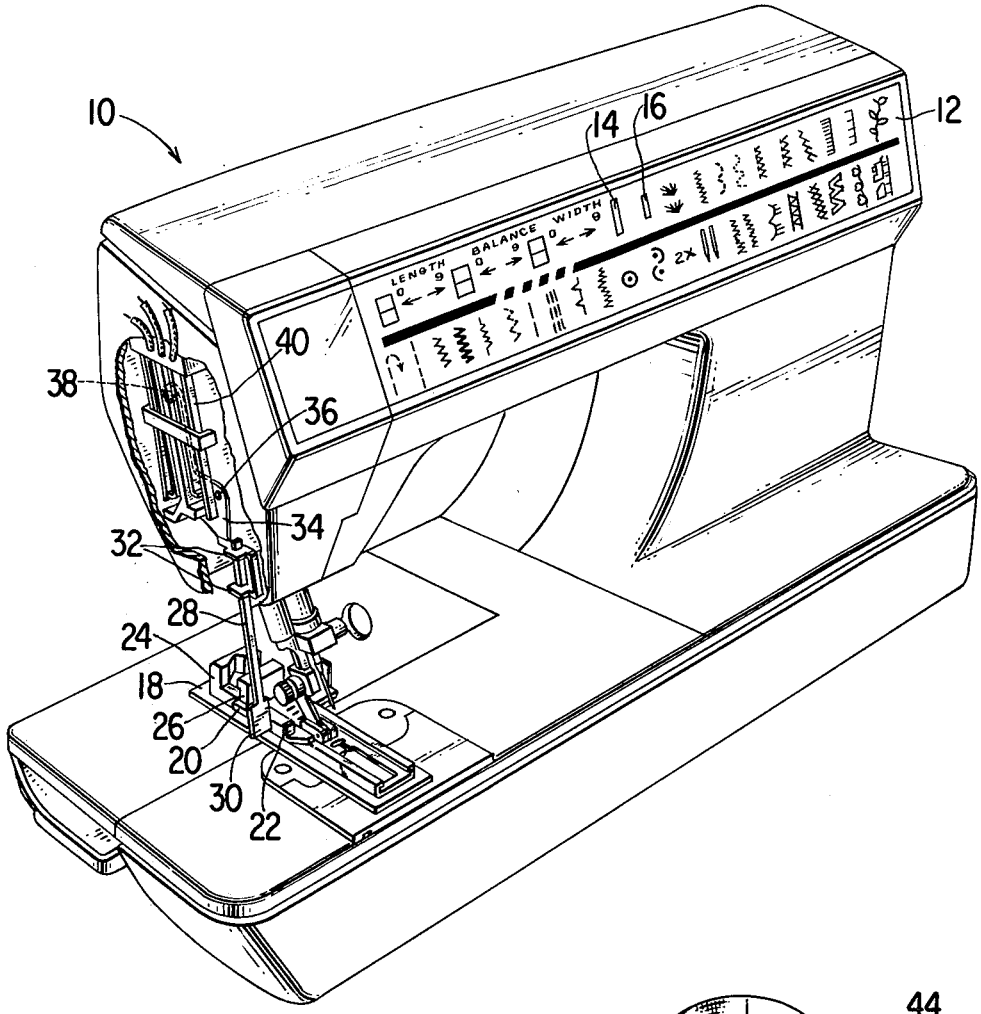
FIG. 1 is a perspective view of the sewing machine in which the method according to this invention may be practiced.

Referring to the drawings, FIG. 1 illustrates a sewing machine indicated generally at 10 having a control panel 12 illustratively of the type utilizing a continuous planar element such as a glass panel to which circuitry is applied as by deposition or the like to provide controls sensitive to the touch of an operator's finger. Indicated on the control panel 12 are touch sensitives areas having respective representations of various stitch patterns which may be automatically sewn by the sewing machine 10.

The sewing machine 10 is provided with the capability of sewing either a large buttonhole, indicated by the large buttonhole representation 14 on the control panel 12, or a small buttonhole, indicated by the small buttonhole representation 16 on the control panel 12. When a buttonhole pattern is to be sewn, a buttonhole presser foot 18 is installed on a sewing machine 10. The buttonhole presser foot 18 includes a fixed rear stop member 20 and an adjustable front stop member 22, the distance therebetween defining the length of the buttonhole pattern being sewn, as determined by the size of button inserted between an anchor element 24 and a buttonhole gauging element 26. The sewing machine 10 further includes a switch mechanism including a lever arm 28 terminating in a paddle 30 at its lower end. The other end of the lever arm 28 is received by openings in a pair of spaced lugs 32 formed on one end of a lever 34. The lever arm 28 may therefore be selectively raised and lowered by an operator, the operator lowering the lever arm 28 so that the paddle 30 is intermediate the stops 20 and 22 during the formation of a buttonhole pattern.

The lever 34 is pivoted at 36; and at the end opposite the lugs 32 has a pin 38 mounted thereon for cooperation with an electrical switch member 40. Manipulation of the paddle 30 on both ends of the buttonhole causes actuation of the electrical switch member 40, which actuation is fed to the electronic control unit for the sewing machine in order to initiate the next of a sequence of steps in the formation of a buttonhole. For further information with respect to the operation of the electrical switch member 40 and the electronic package of the sewing machine, the reader is referred to the U.S. Patent Appl. Ser. No. 928,939, filed on July 28, 1978, now U.S. Pat. No. 4,159,688 and assigned to the assignee of the present invention, the disclosure of which application is hereby incorporated by reference herein.

Figure 3:
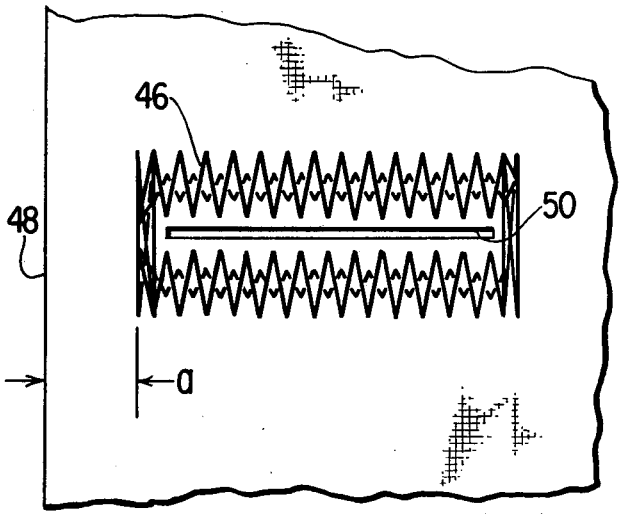
FIG. 3 is a closer view of one of the buttonholes shown in FIG. 2.
Figure 2:
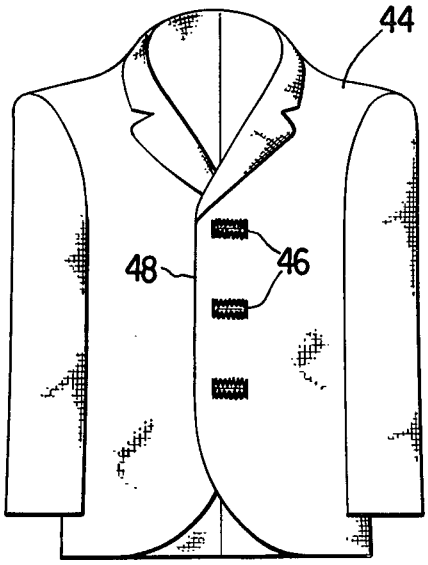
FIG. 2 is an elevation of a garment utilizing buttonholes perendicular to an edge thereof.

As mentioned above, in the background comments, the method of the present invention is concerned with the manufacture of a buttonhole which does not require any balance adjustment and in which the final covering stitches are effected in the forward direction. It was further indicated that this method should be effected in all cases, including those cases where the buttonholes are formed perpendicular to the edge of a garment. In such a situation, it is desirable that the initial stitches for the buttonhole should be formed adjacent the edge of the garment so that any variation in the length of the buttonhole would be spaced from the edge of the garment and thereby rendered less noticeable. Referring to FIG. 2, there is shown such a garment 44 in which buttonholes 46 are spaced on the front thereof along an edge 48. A single buttonhole 46 is shown in greater detail in FIG. 3. The buttonhole slit 50 is arranged perpendicular to the edge 48 of the garment 44. With any arrangement of this fashion, it is preferable that the initial stitching be a bar tack closest to the edge 48 of the garment so as to be able to provide close operator control over the spacing "A" of the buttonhole from the edge of the garment. Thus, as has been repeated above, any variation in the length of the buttonhole 46 will take place inwardly of the garment and away from the edge 48 thereof so as to make any error less perceptible by reason of spacing from the edge 48.

Figure 5:
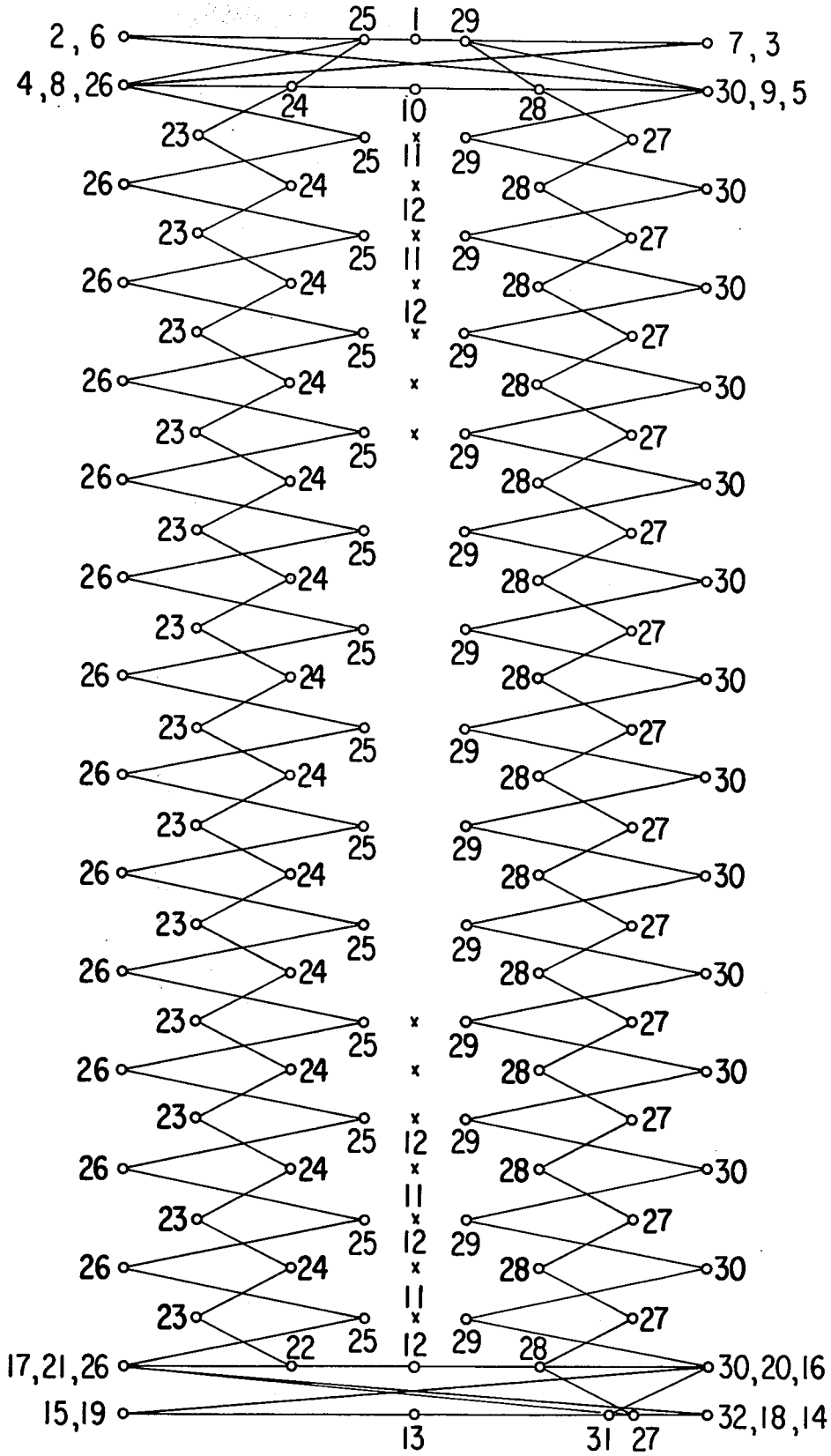
FIG. 5 is a representation of the buttonhole pattern formed from the data illustrated in FIG. 4.

Referring now to FIG. 4, there is shown encoded data for the formation of a large buttonhole pattern, such encoded data being stored in a memory as is explained in the above referenced application. FIG. 5 is a representation of the large buttonhole pattern formed from the data illustrated in FIG. 3. The encoded data stored in the memory comprises a twelve bit digital word for each stitch as is shown under the code column of FIG. 4. In each of these digital words, the five left most bits corresponds to the feed increment for the immediately following stitch, the next five bits corresonds to the bight position for the present stitch, the eleventh bit is a control bit which may be utilized to decrement the address counter so as to address the previous word again, and the twelfth bit is a control bit which may be used to initiate basting. For an explanation of a basting stitch mechanism which may be implemented by the twelfth control bit the reader is referred to the U.S. Pat. No. 3,872,809 of Adams et al which is hereby incorporated by reference herein. By use of the eleventh bit, a side bar of infinite length may be sewn from two code words which form a "loop", the exit from which is controlled by operation of the switch member 40 at both ends of the buttonhole pattern.

Referring to FIG. 5, each lateral bight actuator position and corresponding incremental feed displacement which resulted in a stitch in the large buttonhole pattern coded as shown in FIG. 4 is represented by a small open circle, with the stitch number closely adjacent thereto. The first ten stitches form the upper bar with the tenth stitch in center needle position. Stitches eleven and twelve are straight, or basting, stitches in center needle position having a small feed increment, with the twelfth stitch having the eleventh control bit of one to indicate that the previous stitch should be return to until the paddle 30 is actuated by the front stop member 22 to initiate the second bar tack, stitches 13 through 21. The encoded data of FIG. 4 shows a high ("1") for the twelfth bit of stitches eleven and twelve, indicating that these are skipped stitches where the work material is advanced without stitch formation. The lack of stitching is indicated in FIG. 5 by an X. The line or stitching would be terminated by actuation of the electrical switch member 40. Stitches 22, 23 and 24 initiate the first layer of cording stitches in the reverse direction on the left side of the buttonhole, the stitch 24 having a control bit value of one to indicate that the previous stitch should be return to until the paddle 30 is actuated by the rear stop member 20. Thereupon, the cording stitch is overlaid by stitches 25 and 26 effected in the forward direction, stitch 26 having a control bit indicating a return to the previous stitch coordinates until the paddle 30 is actuated by the front stop member 22. The right side cording stitches and overlying stitches are effected in the same manner as the left side stitches, the last actuation of the paddle 30 by front stop member 22 causing the sewing machine to cease further stitching and feeding operations. Thus, the final overlay stitches for the left and right side bars are sewn in the same forward direction, control of feed balance is not necessary to provide for the formation of uniform and consistent buttonhole, and the buttonhole is initiated with a bar tack lying adjacent the edge 48 of a garment 44 to be stitched.

Accordingly, there has been disclosed an improved method of sewing a buttonhole pattern. It is understood that the above-described method is merely illustrative of the application of the principles of this invention, and it is only intended that this invention be limited by the scope of the appended claims.

We claim:

1. A method of operating a zig zag sewing machine to produce a buttonhole pattern on a work material, the buttonhole pattern including two spaced apart rows of zig zag stitches, each row having a width less than one half the total width of the two parallel rows side by side, there being a separation between the two parallel rows to define the cutting space of the buttonhole pattern, said method comprising the steps of:

a. sewing a first plurality of zig zag barring stitches having a width equal to the total width of the buttonhole and with the last stitch located in the center of the total width;

b. feeding the work material in a forward direction to the opposite end of the buttonhole;

c. sewing a first row of narrow zig zag cording stitches in a reverse direction and extending the length of the buttonhole, said cording stitches having a width less than the width of one of said parallel rows;

d. sewing one of said parallel rows of zig zag stitches in a forward direction extending the length of said buttonhole pattern and overlying said first row of cording stitches;

e. sewing a second row of narrow zig zag cording stitches in said reverse direction extending the length of the buttonhole, said cording stitches having a width less than the width of one of said parallel rows, said second row of cording stitches being parallel to said first row of cording stitches; and, f. sewing the second of said parallel rows of zig zag stitches in a forward direction extending the length of said buttonhole and overlying said second row of cording stitches.

2. The method of claim 1 further including the step of:

g. prior to step c sewing a second plurality of zig zag barring stitches having a width equal to the total width of the buttonhole on said opposite end of said buttonhole.

3. The method of claim 2 wherein said feeding step is accomplished while skipping stitches.

* * * * *